US012241718B2

(12) United States Patent
Beaman et al.

(10) Patent No.: US 12,241,718 B2
(45) Date of Patent: Mar. 4, 2025

(54) PASSIVE LINE SEPARATOR

(71) Applicant: Raytheon Company, Tewksbury, MA (US)

(72) Inventors: Richard O. Beaman, Tucson, AZ (US); Dmitry V. Knyazev, Tucson, AZ (US); Peter D. Dunning, Tucson, AZ (US)

(73) Assignee: Raytheon Company, Tewksbury, MA (US)

( * ) Notice: Subject to any disclaimer, the term of this patent is extended or adjusted under 35 U.S.C. 154(b) by 0 days.

(21) Appl. No.: 17/931,657

(22) Filed: Sep. 13, 2022

(65) Prior Publication Data

US 2024/0093964 A1 Mar. 21, 2024

(51) Int. Cl.
*F41F 3/055* (2006.01)

(52) U.S. Cl.
CPC ..... *F41F 3/055* (2013.01)

(58) Field of Classification Search
CPC ..... F41F 3/055
USPC ..... 89/1.811
See application file for complete search history.

(56) References Cited

U.S. PATENT DOCUMENTS 2,870,676 A * 1/1959 Radkowski ..... F41F 3/055 30/240
3,167,047 A * 1/1965 Eug ..... F41F 3/10 83/580
3,780,617 A * 12/1973 Tabarie ..... F41F 3/055 83/199
3,882,748 A * 5/1975 Moore ..... B23D 23/00 83/543
6,663,049 B1 12/2003 Jakubowski, Jr. et al.
2015/0153135 A1* 6/2015 Merems ..... F41F 3/055 89/1.811
2018/0347942 A1* 12/2018 Bae ..... F41F 3/055

FOREIGN PATENT DOCUMENTS

GB 2249620 A * 5/1992 ..... B64G 1/421
KR 101004793 1/2011
WO 2024076793 4/2024

OTHER PUBLICATIONS

"International Application Serial No. PCT US2023 070133, International Search Report mailed Jun. 5, 2024", 3 pgs.
"International Application Serial No. PCT US2023 070133, Written Opinion mailed Jun. 5, 2024", 6 pgs.

* cited by examiner

*Primary Examiner* — Joshua E Freeman
*Assistant Examiner* — Benjamin S Gomberg
(74) *Attorney, Agent, or Firm* — Schwegman Lundberg & Woessner, P.A.

(57) ABSTRACT

A launcher for launching a flying vehicle, such as a projectile or missile, includes a cutter for cutting a line, such as an umbilical line, that is coupled to the vehicle prior to launch. An example of a line is a tube for providing cooling for onboard components of the vehicle, such as a seeker of the vehicle. The cutter may be part of a mount of the launcher for mounting the line and other components, such as a compressor. The cutter may be configured so that as the vehicle translates relative to the launcher during the initiation of launch, the line moves against the cutter, severing the line. The cutter may retract after severing the line, for example being pulled away from the vehicle (and into the mount) by a spring mechanism.

20 Claims, 2 Drawing Sheets

PASSIVE LINE SEPARATOR

GOVERNMENT LICENSE RIGHTS

This disclosure was made with Government support under contract number FA8651-20-D-0001, awarded by the United States Air Force. The Government has certain rights in the invention.

FIELD

The disclosure is in the field of launched vehicles, such as missiles.

BACKGROUND

Missile seekers are used to control trajectories of missiles, and to guide missiles toward intended targets. Cooled seekers may be much more sensitive than seekers that are not cooled, so it is advantageous to cool seekers, even to cryogenic temperatures. Yet space is at a premium within missiles, so it is desirable to move the volume (and weight) of the cooler outside of the missile, when possible. Accordingly coolers have been located outside of the missile, with a connection provided to the missile in the form of a line that provides cooling to the seeker. However it is necessary to disconnect the cooler from the missile for operation of the missile.

SUMMARY

A cutter is used to sever a tube or line that couples to vehicle such as a missile, prior to launch. Movement of the vehicle pushes the tube or line against the cutter, causing the severing.

According to an aspect of the disclosure, a mechanism for severing a line as part of a launch process for launching a vehicle from a launcher, includes: a mount of the launcher that supports the line; and a cutter coupled to the mount; wherein launch of the vehicle from the launcher causes movement of the vehicle relative to the mount that causes the cutter to sever the line.

According to an embodiment of any paragraph(s) of this summary, the cutter is configured to retract into the mount after the cutter severs the line.

According to an embodiment of any paragraph(s) of this summary, wherein the cutter is part of a cutter assembly that includes a spring that biases the cutter to retract into the mount.

According to an embodiment of any paragraph(s) of this summary, wherein the spring is part of a spring pack that includes a series of coil springs on an annular frame.

According to an embodiment of any paragraph(s) of this summary, the cutter has an annular shape defining a central cutter opening.

According to an embodiment of any paragraph(s) of this summary, the line passes through the central cutter opening.

According to an embodiment of any paragraph(s) of this summary, the cutter has a notch that allows the line to pass from outside the cutter into the central cutter opening.

According to an embodiment of any paragraph(s) of this summary, the cutter assembly further includes a ferrule nut that secures in the central cutter opening a ferrule that is installed on the line.

According to an embodiment of any paragraph(s) of this summary, the cutter has a curved cutter blade.

According to an embodiment of any paragraph(s) of this summary, the cutter has an anti-rotation feature that prevents rotation of the cutter within a mount hole in the mount.

According to an embodiment of any paragraph(s) of this summary, the cutter assembly further includes a retention nut that secures the cutter assembly to the mount.

According to an embodiment of any paragraph(s) of this summary, the retention nut can be adjusted to adjust protrusion of a cutter blade of the cutter from the mount.

According to an embodiment of any paragraph(s) of this summary, the mount includes a compressor.

According to an embodiment of any paragraph(s) of this summary, in combination with the line.

According to an embodiment of any paragraph(s) of this summary, the line is a tube.

According to an embodiment of any paragraph(s) of this summary, the tube is a metal tube.

According to an embodiment of any paragraph(s) of this summary, the line is an umbilical line that provides services to the vehicle prior to launch.

According to an embodiment of any paragraph(s) of this summary, in combination with the vehicle, wherein the vehicle is a missile.

According to another aspect of the disclosure, launcher for launching a vehicle, the launcher includes: a canister that contains the vehicle prior to launch; a mount attached to the canister, with the mount hosting a line that extends into the vehicle prior to launch; and a cutter coupled to the mount, where the cutter severs the line as part of launch of the vehicle from the launcher.

According to yet another aspect, a method of launching a vehicle from a launcher, the method includes: moving the vehicle within the launcher; and cutting a line between the launcher and the vehicle; wherein the movement of the vehicle within the launcher cuts the line.

According to an embodiment of any paragraph(s) of this summary, the movement of the vehicles presses the line against a cutter of the launcher, to cut the line.

While a number of features are described herein with respect to embodiments of the disclosure; features described with respect to a given embodiment also may be employed in connection with other embodiments. The following description and the annexed drawings set forth certain illustrative embodiments of the disclosure. These embodiments are indicative, however, of but a few of the various ways in which the principles of the disclosure may be employed. Other objects, advantages, and novel features according to aspects of the disclosure will become apparent from the following detailed description when considered in conjunction with the drawings.

BRIEF DESCRIPTION OF THE DRAWINGS

The annexed drawings, which are not necessarily to scale, show various aspects of the disclosure.

DETAILED DESCRIPTION

A launcher for launching a flying vehicle, such as a projectile or missile, includes a cutter for cutting a line, such as an umbilical line, that is coupled to the vehicle prior to launch. An example of a line is a tube for providing cooling for onboard components of the vehicle, such as a seeker of the vehicle. The cutter may be part of a mount of the launcher for mounting the line and other components, such as a compressor. The cutter may be configured so that as the vehicle translates relative to the launcher during the initiation of launch, the line moves against the cutter, severing the line. The cutter may retract after severing the line, for example being pulled away from the vehicle (and into the mount) by a spring mechanism. The retraction of the cutter may allow clearance to allow other parts of the vehicle to pass through the launcher. The cutter advantageously works passively, just through movement of the flight vehicle in the launch process, without the use of explosives or moving parts to sever the line.

Figure 1:
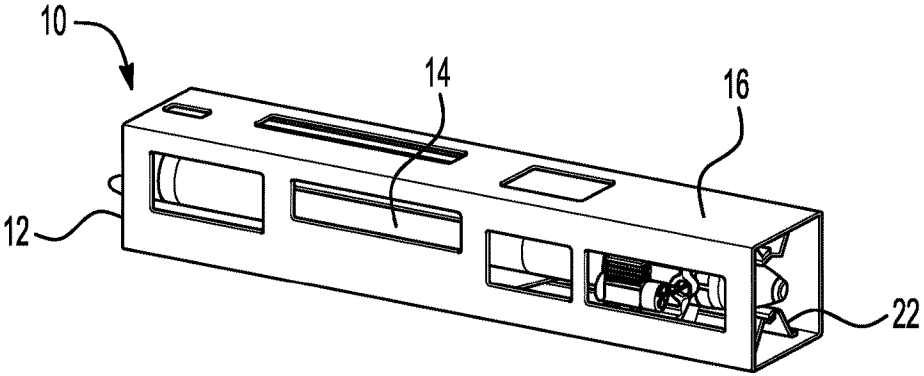
FIG. 1 is an oblique view of a launch system according to an embodiment.
Figure 2:
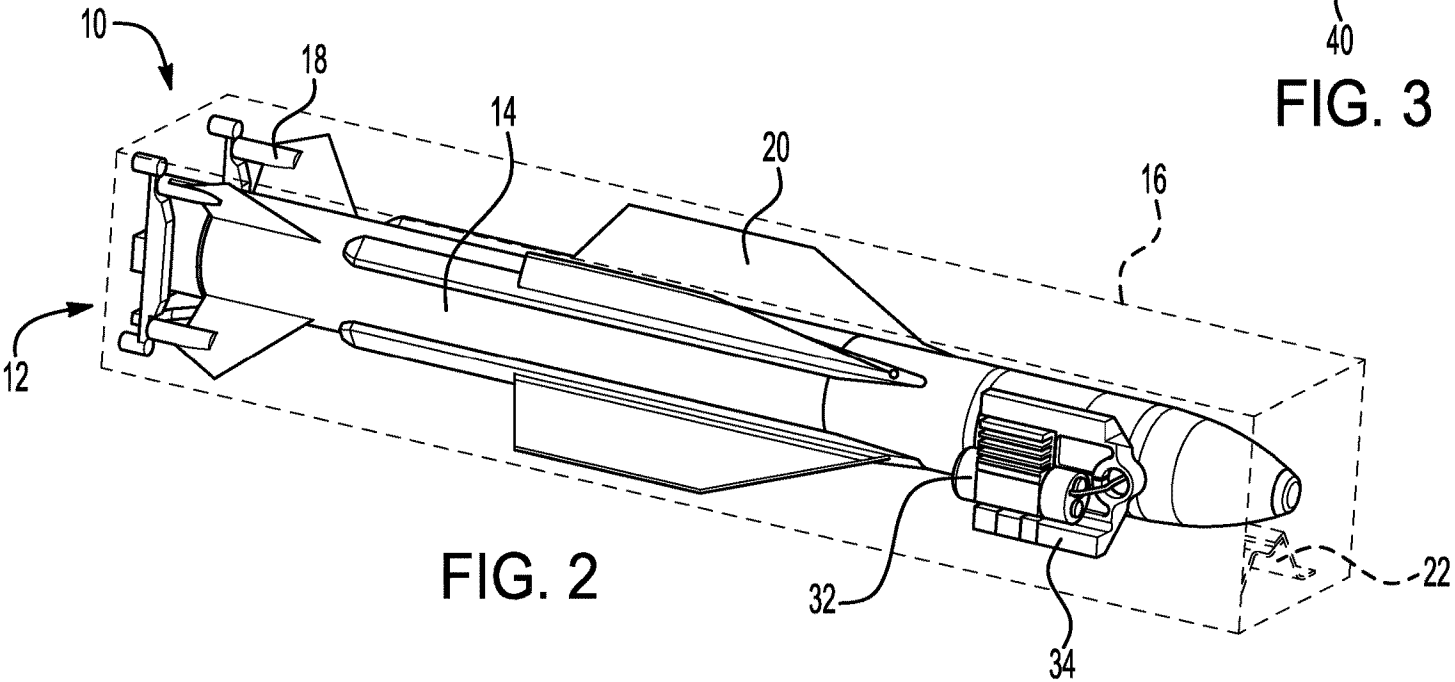
FIG. 2 is an oblique view of elements of the launch system of FIG. 1, with other elements shown as transparent for illustration purposes.

FIGS. 1 and 2 show a launch system 10 that includes a launcher 12 for launching a flight vehicle, such as a missile 14. The launcher 12 includes a canister 16 that contains and stores the missile 14, from which the missile 14 emerges during the launch process. The launcher 12 also includes mechanical structures that support the missile 14 and facilitate launch, for example fin locks 18 that support fins 20 of the missile 14, and ribs or tracks 22 that support the missile 14 as the missile 14 is launched.

It is advantageous for the launcher 12 to include non-flight-required components outside of the missile 14, to provide pre-launch service to the missile 14. An example of a non-flight-required component is a cryocooler, to provide cooling to the missile 14, for example to provide cooling to a seeker on the missile 14. The cryocooler (or component(s) thereof, such as a compressor 32) are located on a mount 34 of the launcher 12. The mount 34 may be mounted on a wall of the launcher canister 16.

Figure 3:
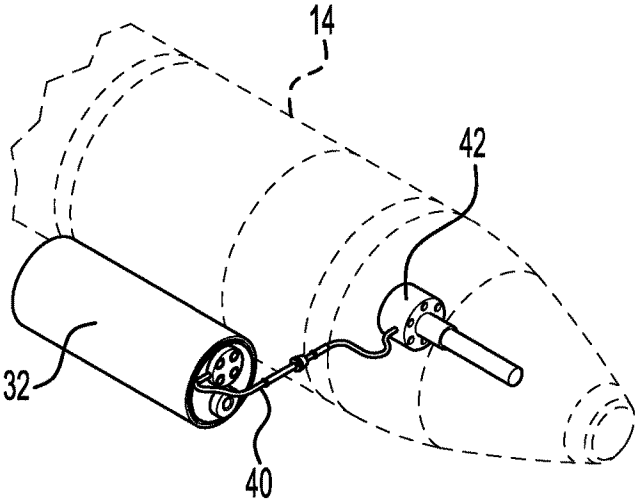
FIG. 3 is an oblique view showing components of the cooling system of the launch system of FIG. 1.

With reference in addition to FIG. 3, an umbilical line 40 runs from the cryocooler compressor 32 (outside of the missile 14) to a seeker 42 that is a part of the missile 14. The line 40 may be a tube, such as a metal conduit or tube. The line 40 runs from the compressor 32, into the missile 14, and to the seeker 42. The line 40 may be used for circulating fluid to the seeker 42 to cool the seeker 42.

Figure 4:
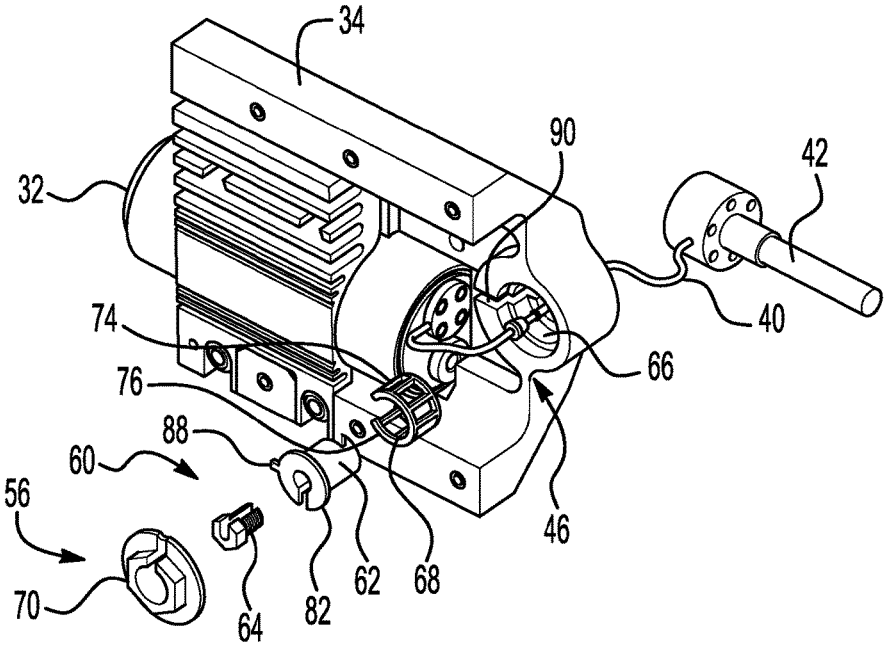
FIG. 4 is an exploded view showing components of the launch system, including the cutter assembly.
Figure 5:
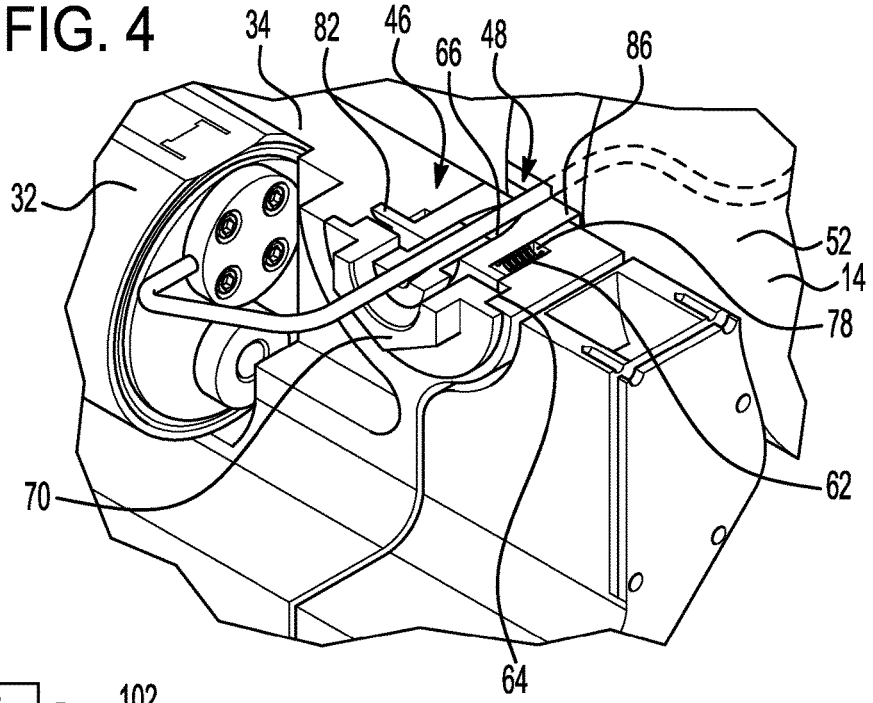
FIG. 5 is a partial sectional view showing components of the cutter assembly.

FIGS. 4 and 5 show further details of the routing of the umbilical line 40, and of the configuration of components that are coupled to the mount 34. The mount 34, which may be in any of a variety of shapes, receives and secures the compressor 32. The line 40 emerges from the compressor 32, and passes through a hole 46 in the mount 34, and into the missile 14 through a corresponding hole 48 in the skin 52 of the missile 14, where the line 40 connects to the seeker 42. The line 40 is configured to be severed by a cutting mechanism 56.

A cutter assembly 60 of the cutting mechanism 56 is located in the mount hole 46. The cutter assembly 60 includes a cutter 62, a ferrule nut 64 that is used in conjunction with a ferrule 66 on the line 40 to hold the line 40, a spring pack 68, and a retention nut 70. The spring pack (or spring or resilient device) 68 is loaded into the mount hole 46, between a bottom of the hole 46 and the cutter 62. The spring pack 68 may be or may include any of a variety of resilient devices. In one embodiment the spring pack 68 may include a series of a coil springs 74 circumferentially spaced around an annular frame 76.

The spring pack 68 may have an annular shape, and may be around the cutter 62. The spring pack 68 fits in the mount hole 46, between a seat 78 of the hole 46, and a flange 82 of the cutter 62. The spring 68 operates to bias the cutter 62 to retract into the mount 34 after the cutter 62 cuts the line 40.

The ferrule nut 64 is threaded into an internally-threaded hole of the cutter 62 to the secure the ferrule 66 (and the line 40) in the internally-threaded hole. The cutter 62, ferrule nut 64, and the spring pack 68 may all have axially-directed notches that allow installation on the line 40 with the line 40 already in place through the mount hole 46.

The retention nut 70 threads into the mount hole 46, to retain the cutter assembly 60 in the mount hole 46. The retention nut 70 has a central opening that allows access through the opening to a head of the ferrule nut 64.

The cutter 62 is configured to prevent rotation of the cutter 62 relative to the mount 34. This keeps the cutter 62 in a position for a blade 86 of the cutter 62 to cut the line 40 as the missile 14 is launched. Toward this end the cutter 62 has an anti-rotation feature, in the illustrated embodiment a protrusion 88 on the cutter flange 82 that engages a groove 90 in the mount 34. The anti-rotation feature may take any of a variety of forms, for example being a dowel pin that extends out from the cutter 62. Alternatively the mount hole 46 may have an inward protrusion that engages a groove or recess in the cutter 62.

The cutter blade 86 may be a curved blade, as shown in the illustrated embodiment. The curved blade 86 may be shaped to be similar to the shape of an outer surface of the line 40, and/or to guide and/or contain the line 40 during the cutting process. Alternatively the blade 86 may have other shapes, such as straight or angled.

The cutter 62 may be made of steel or another suitable metal material. Other components of the cutter assembly 60 may be made of suitable metals.

The location of the cutter blade 86 relative to the missile skin 52 may be adjusted to be at a desired distance from the missile skin 52. For example, a thickness gage may be placed against the missile skin 52, and the cutter blade 86 position adjusted by turning the retention nut 70.

Figure 6:
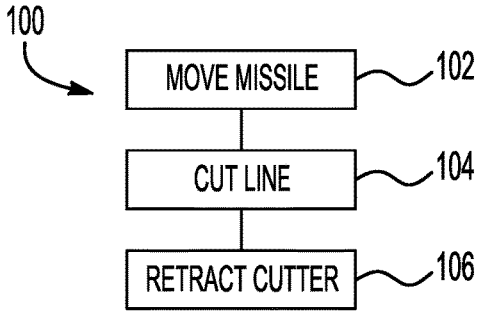
FIG. 6 is a high-level flowchart of steps of a method, according to an embodiment.

FIG. 6 shows a high-level flowchart of a method 100 of launching a vehicle from a launcher, such as launch of the missile 14 (FIG. 1) from the launcher 12 (FIG. 1). In step 102 the missile 14 moves within the launcher 12. This movement brings the line 40 (FIG. 5) into contact with the blade 86 (FIG. 5) of the cutter 62 (FIG. 4), and as a result, in step 104 the line 40 is cut by the cutter 62. In step 106 the cutter 62 retracts into the mount 34 (FIG. 4), under the spring force of the spring assembly 68 (FIG. 4). This retraction of the cutter 62 increases the clearance around the missile skin 52 (FIG. 5). This may allow passage of parts of the missile 14, such as folded or retracted fins, past the retracted cutter 62 as the missile 14 continues its motion out of the launcher 14.

The line 40 is described above as a metal tube for cooling. Alternatively the line may be a tube for other purposes, or another type of connection, for example a wire or wire bundle. The line may be rigid, or may have some flexibility.

The launch has been described above as involving a missile emerging from a canister. Alternatively the launch may be of another type of vehicle, or may be (to give a non-limiting example) a projectile being fired by a gun, with a line to the projectile being severed as part of the launch process.

The launch system and cutter described above advantageously allow for passive disengagement of the line from a vehicle during the launch process, using the motion of the launching vehicle as the motive force for accomplishing the severing. No explosives, coupling, or moving severing mechanisms are required. The cutter advantageously retracts after the severing, to provide greater clearance between the vehicle (missile) and the launcher.

Although the disclosure has been shown and described with respect to a certain embodiment or embodiments, equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the disclosure. In addition, while a particular feature of the disclosure may have been described above with respect to only one or more of several illustrated embodiments, such feature may be combined with one or more other features of the other embodiments, as may be desired and advantageous for any given or particular application.

What is claimed is:

1. A mechanism for severing a line as part of a launch process for launching a vehicle from a launcher, the mechanism comprising:

a mount of the launcher that supports the line; and a cutter coupled to the mount;

wherein launch of the vehicle from the launcher causes movement of the vehicle relative to the mount that causes the cutter to sever the line, wherein the cutter is configured to retract into the mount after the cutter severs the line.

2. The mechanism of claim 1, wherein the cutter is part of a cutter assembly that includes a spring that biases the cutter to retract into the mount.

3. The mechanism of claim 2, wherein the spring is part of a spring pack that includes a series of coil springs on an annular frame.

4. The mechanism of claim 2, wherein the cutter has an annular shape defining a central cutter opening.

5. The mechanism of claim 4, wherein the line passes through the central cutter opening.

6. The mechanism of claim 5, wherein the cutter has a notch that allows the line to pass from outside the cutter into the central cutter opening.

7. The mechanism of claim 5, wherein the cutter assembly further includes a ferrule nut that secures in the central cutter opening a ferrule that is installed on the line.

8. The mechanism of claim 2, wherein the cutter has a curved cutter blade.

9. The mechanism of claim 2, wherein the cutter has an anti-rotation feature that prevents rotation of the cutter within a mount hole in the mount.

10. The mechanism of claim 2, wherein the cutter assembly further includes a retention nut that secures the cutter assembly to the mount.

11. The mechanism of claim 10, wherein the retention nut can be adjusted to adjust a position of a cutter blade of the cutter.

12. The mechanism of claim 1, wherein the mount includes a compressor coupled to the line.

13. The mechanism of claim 1, in combination with the line.

14. The mechanism of claim 13, wherein the line is a tube.

15. The mechanism of claim 13, wherein the line is an umbilical line that provides services to the vehicle prior to launch.

16. The mechanism of claim 1, in combination with the vehicle, wherein the vehicle is a missile.

17. A launcher for launching a vehicle, the launcher comprising:

a cannister that contains the vehicle prior to launch;

a mount attached to the cannister, with the mount hosting a line that extends into the vehicle prior to launch; and a cutter coupled to the mount, where the cutter severs the line as part of launch of the vehicle from the launcher, wherein the cutter is configured to retract into the mount after the cutter severs the line.

18. The launcher of claim 17, wherein the cutter is part of a cutter assembly that includes a spring that biases the cutter to retract into the mount.

19. A method of launching a vehicle from a launcher, the launcher including a mount hosting a line that extends into the vehicle prior to launch and a cutter, the method comprising:

moving the vehicle within the launcher to press the line against the cutter to cut the line; and retracting the cutter into the mount after the cutter severs the line.

20. The method of claim 19, wherein retracting the cutter into the mount after the cutter severs the line comprises positioning a spring to bias the cutter to retract into the mount after the cutter severs the line.

* * * * *